US009214054B2

(12) United States Patent
Chen et al.

(10) Patent No.: US 9,214,054 B2
(45) Date of Patent: Dec. 15, 2015

(54) DRIVING DEVICE FOR VENDING MACHINE

(71) Applicant: ShenZhen Treasure City Technology Co., LTD., ShenZhen (CN)

(72) Inventors: Yun-Lung Chen, New Taipei (TW); Chung Chai, New Taipei (TW); Da-Long Sun, Wuhan (CN); Wei-Yong Ma, Wuhan (CN)

(73) Assignee: ShenZhen Treasure City Technology Co., LTD., ShenZhen (CN)

( * ) Notice: Subject to any disclaimer, the term of this patent is extended or adjusted under 35 U.S.C. 154(b) by 398 days.

(21) Appl. No.: 13/906,745

(22) Filed: May 31, 2013

(65) Prior Publication Data

US 2014/0048756 A1 Feb. 20, 2014

(30) Foreign Application Priority Data

Aug. 17, 2012 (CN) ..... 2012 1 0293768

(51) Int. Cl.
*B66F 3/08* (2006.01)
*G07F 11/42* (2006.01)

(52) U.S. Cl.
CPC ..... *G07F 11/42* (2013.01)

(58) Field of Classification Search
USPC ..... 254/98, 100, 105; 221/75, 85, 258
See application file for complete search history.

(56) References Cited

U.S. PATENT DOCUMENTS 4,124,142 A * 11/1978 Albright ..... G07F 11/36 221/75
4,436,194 A * 3/1984 Hanley ..... G07F 11/58 194/292
5,186,355 A * 2/1993 VonDelinde ..... G07F 11/42 221/258
7,559,437 B2 * 7/2009 Colelli ..... G07G 3/003 211/1

* cited by examiner

*Primary Examiner* — Lee D Wilson
*Assistant Examiner* — Shantese McDonald
(74) *Attorney, Agent, or Firm* — Novak Druce Connolly Bove + Quigg LLP

(57) ABSTRACT

A driving device in a vending machine includes a pushing member, a securing member, and a driving assembly. The motor of the driving assembly provides a rotating force which acts on the securing member, and the securing member supports and rotates the helical pushing member, to drive goods out of the vending machine. The style of attachment between the pushing member and the securing member is such that the starting angle of the helical pushing member can be adjusted by unclipping the end of the pushing member with fingertip force from the securing member and reclipping it at a different preferred orientation. The driving device is used for adjusting the appropriate rotation angle of the pushing member.

18 Claims, 5 Drawing Sheets

DRIVING DEVICE FOR VENDING MACHINE

BACKGROUND

1. Technical Field

The present disclosure relates to a driving device for a vending machine.

2. Description of Related Art

A driving assembly of a vending machine generally includes a motor and a helical member. The motor drives the helical member to rotate thereby driving the goods to drop out of the vending machine. The appropriate rotation angle of the helical member for different goods may be different. Thus, the driving assembly with an adjustable helical member is needed.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
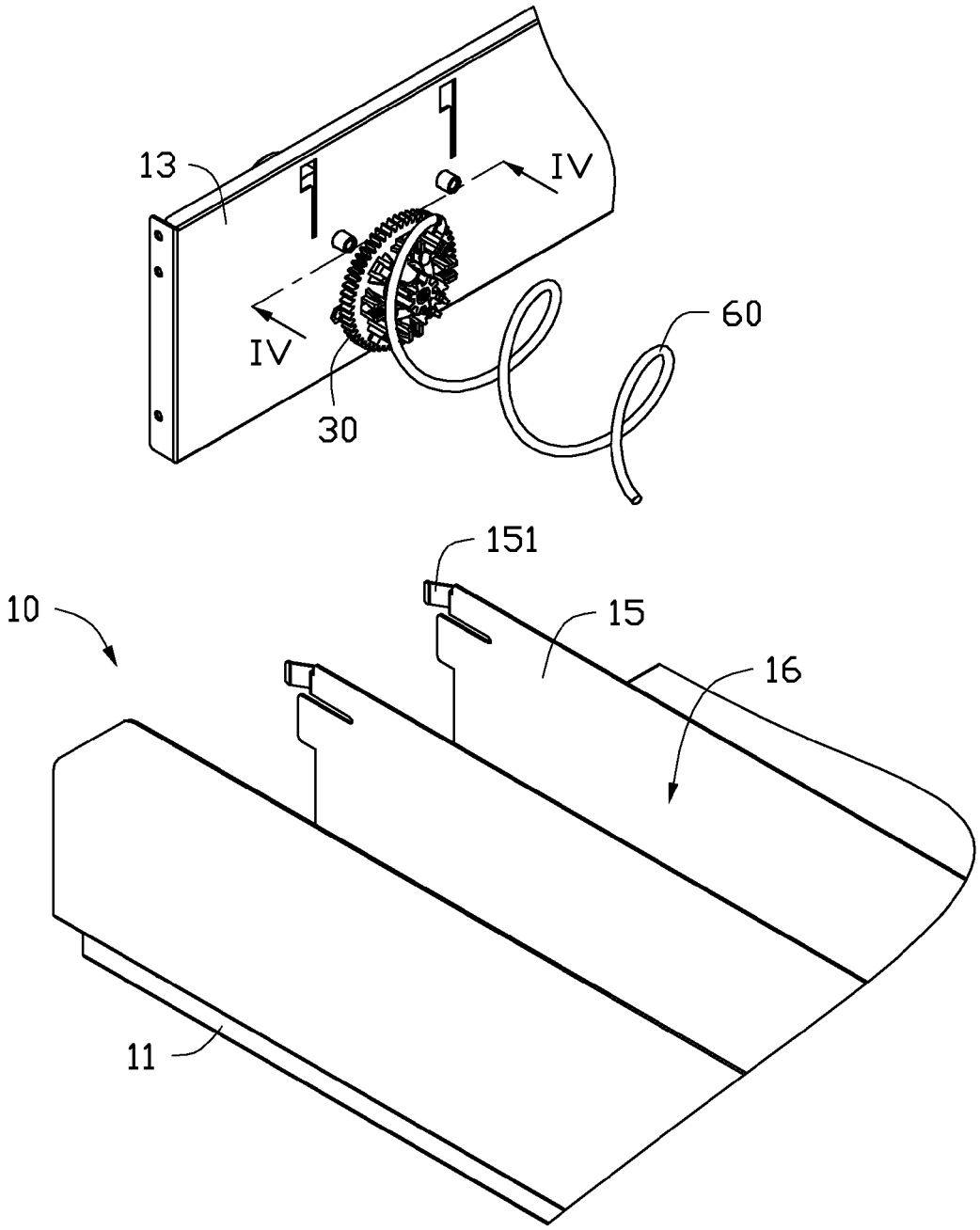
FIG. 1 is an exploded, isometric view of a driving device in accordance with one embodiment of the present disclosure.
Figure 2:
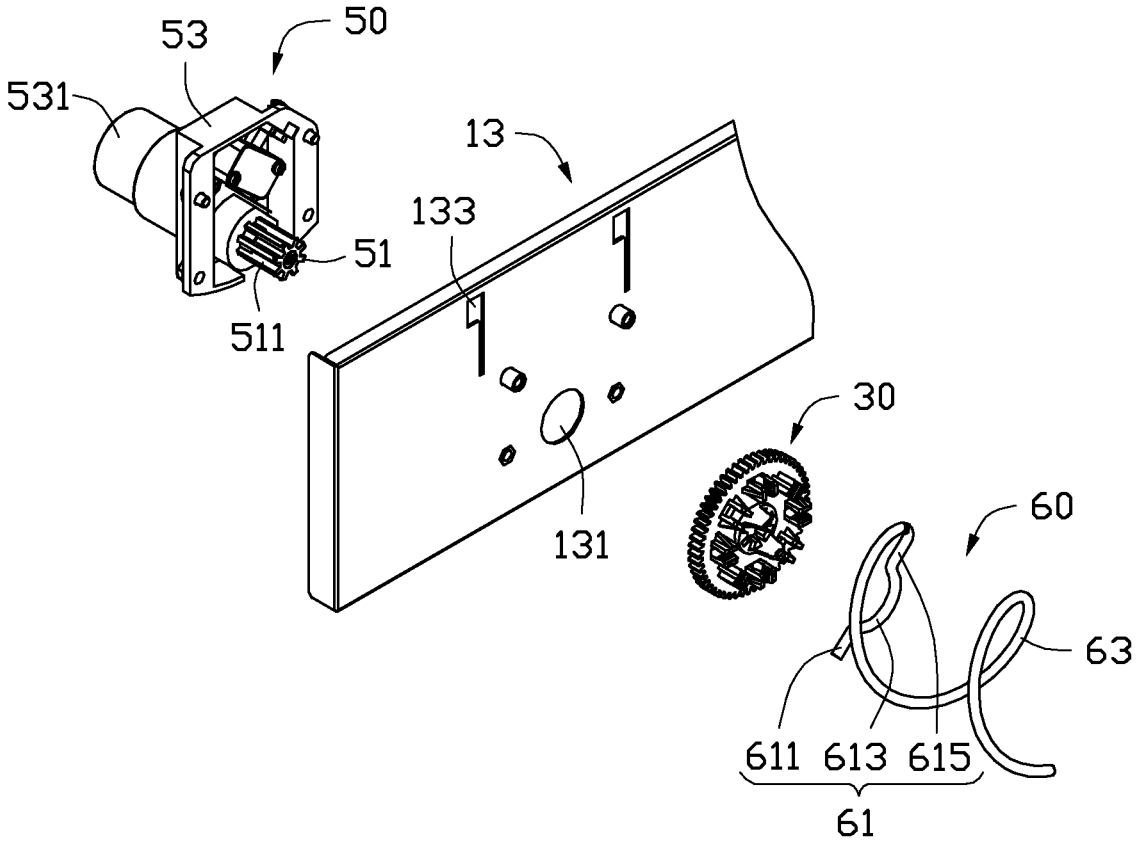
FIG. 2 is an exploded, isometric view of a securing panel, a securing member, a driving assembly, and a pushing member of FIG. 1.

FIGS. 1 and 2, a driving device includes a base 10, a securing panel 13, a securing member 30, a driving assembly 50, and a pushing member 60. The driving device moves goods, which are located on the pushing member 60, out of the base 10 by rotating the pushing member 60.

The base 10 includes a bottom panel 11. A plurality of separating panels 15 are placed on and substantially perpendicular to the bottom panel 11. The plurality of separating panels 15 are substantially parallel to each other. Each separating panel 15 includes a hook 151. A channel 16 is defined between two adjacent separating panels 15. The channel 16 carries the goods and frames the pushing member 60.

The securing panel 13 is secured to the bottom panel 11 and the side panel 12. The securing panel 13 defines a receiving hole 131 for receiving the driving assembly 50 and a plurality of securing holes 133 corresponding to the hooks 151.

Figure 3:
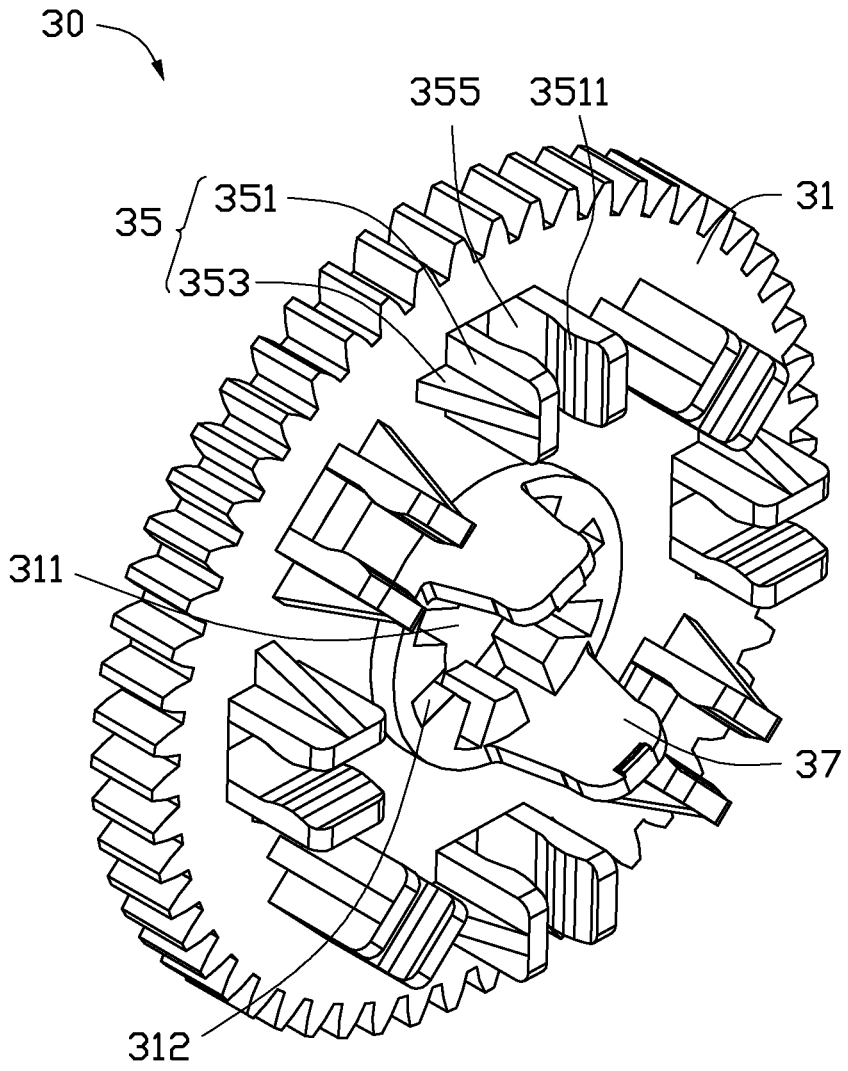
FIG. 3 is an isometric view of a securing member of FIG. 1.

FIGS. 1 to 3 show that the securing member 30 includes a securing tray 31 and a plurality of securing portions 35 extending from the securing tray 31. Each securing portion 35 includes two clasping portions 351 and two support portions 353 extending from the two clasping portions 351. Each securing portion 35 defines a clasping slot 355 between the two clasping portions 351. Each clasping portion 351 defines a plurality of dents 3511. The securing tray 31 defines an opening 311 and a plurality of securing slots 312 communicating with the opening 311. The securing member 30 further includes two handling portions 37 extending from the securing tray 31. The two handling portions 37 are located on the edge of the opening 311. The securing portions 35 are equidistantly located, in diametrically-opposed pairs, on the securing tray 31 to surround the opening 311.

The driving assembly 50 includes a connecting member 51 and a driving member 53. The connecting member 51 defines a plurality of securing teeth 511 corresponding to the securing slots 312. The driving member 53 includes a motor 531. The motor 531 includes a rotating shaft (not shown). The motor 531 drives the rotating shaft to rotate. The driving assembly 50 is mounted to the securing panel 13. The connecting member 51 is secured to the rotating shaft.

The pushing member 60 includes a securing end 61 and a pushing portion 63 connected to the securing end 61. The cross sections of the pushing portion 63 and the securing end 61 are circular. The securing end 61 includes a first securing part 611, a connecting portion 613 extending from the first securing part 611, and a second securing part 615 extending from the connecting portion 613. The connecting portion 613 is arc-shaped. The second securing part 615 is connected to the pushing portion 63. The first securing part 611 and the second securing part 615 are arranged in one line. The cross sections of the first securing part 611 and the second securing part 615 are smaller than the clasping slot 355. The pushing portion 63 resembles a large-scale corkscrew. An item of goods is placed between adjacent coils of the corkscrew. In one embodiment, the pushing member 60 is a helical member.

Figure 4:
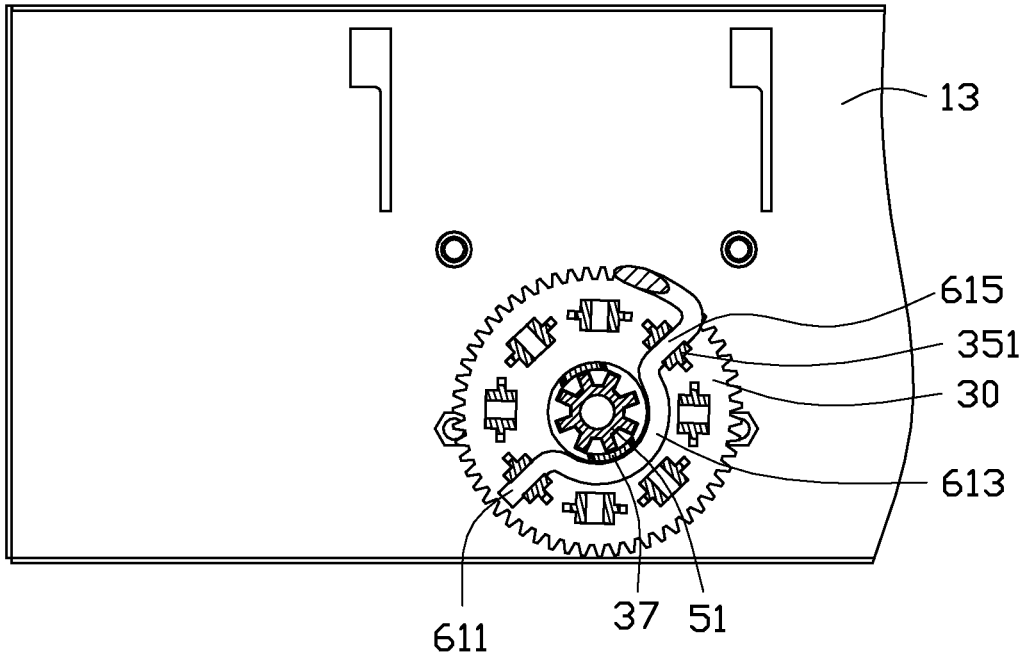
FIG. 4 is a cross-sectional view of FIG. 1 taken along a line IV-IV.
Figure 5:
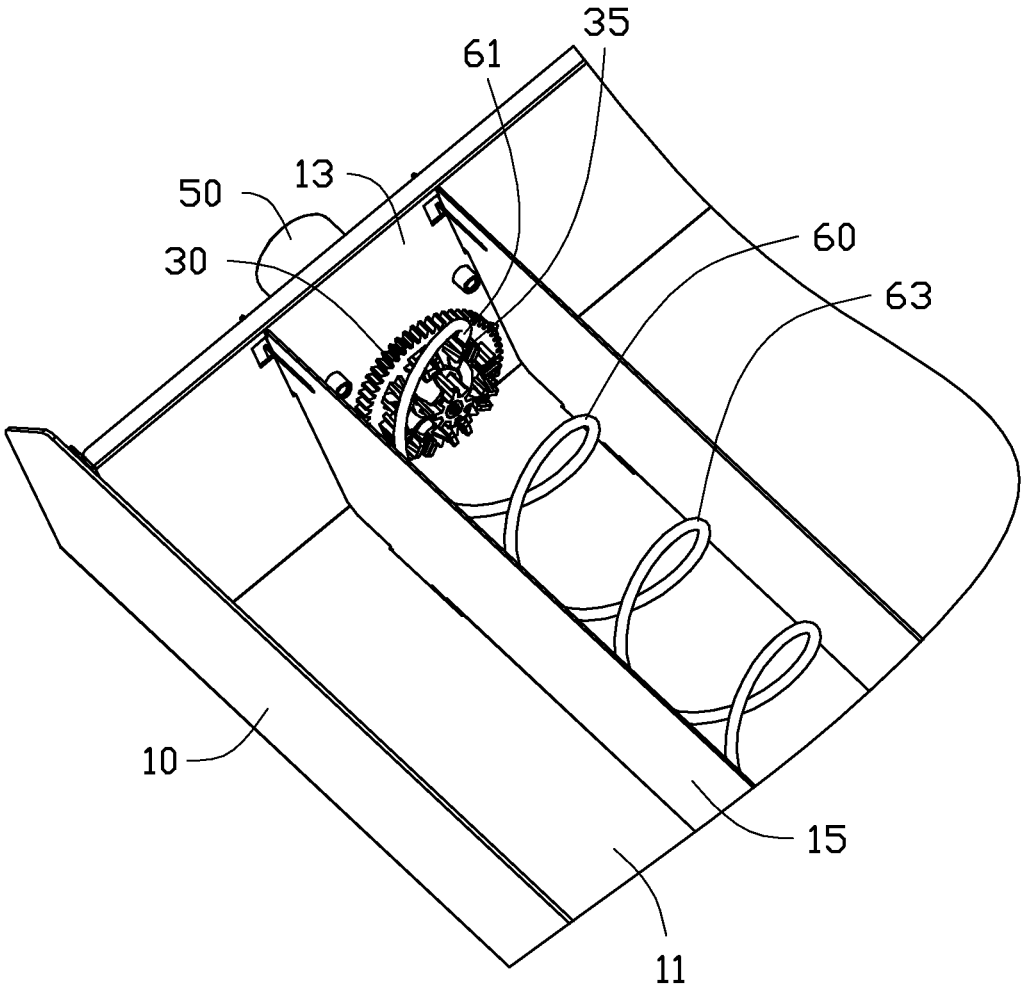
FIG. 5 is an assembled view of the driving device of FIG. 1.

FIGS. 4 and 5 show that, in assembly, the securing panel 13 is secured to the base 10 via screws or jointing. The hooks 151 of the separating panels 15 are engaged in the securing holes 133. The driving member 53 of the driving assembly 50 is placed on the outer side of the securing panel 13 and the connecting member 51 passes through the receiving hole 131 to be placed on the inner side of the securing panel 13. The securing slots 312 are aligned with the securing teeth 511. The securing member 30 moves close to the securing panel 13 to enable the securing teeth 511 to be received in the securing slots 312. At this time, the handle portions 37 clasp the connecting member 51.

The pushing member 60 is placed in the channel 16. The first securing part 611 and the second securing part 615 of the securing end 61 are aligned with any two clasping slots 355. The pushing member 60 moves close to the securing member 30 to enable the first securing part 611 and the second securing part 615 to be clasped by the two clasping slots 355. At this time, the connecting portion 613 follows the contours of the connecting member 51.

When the rotation angle of the pushing member 60 needs adjustment, the securing end 61 of the pushing member 60 is simply lifted by hand from the two clasping slots 355 and placed in another two clasping slots 355, thereby adjusting the rotation angle of the pushing member.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A driving device, comprising:

a pushing member, the pushing member comprises a pushing portion and a securing end extending from the pushing portion;

a securing member; the securing member comprises a securing tray, two first securing portions extending from the securing tray, two second securing portions extending from the securing tray, and two handle portions extending from the securing tray; the securing tray defines an opening; the two handle portions are located on an edge of the opening; each first securing portion comprises two first clasping portions; a first clasping slot is defined between the two first clasping portions; each second securing portion comprises two second clasping portions; and a second clasping slot is defined between the two second clasping portions; and a driving assembly, the driving assembly comprises a connecting member received in the opening and is clasped between the two handle portions;

wherein the securing end is clasped in the two first clasping slots and configured to be clasped in the two second clasping slots to change a rotation angle of the pushing portion.

2. The driving device of claim 1, wherein the securing end comprises a first securing part, a connecting portion extending from the first securing part, a second securing part connected between the connecting portion and the pushing portion; and the connecting portion is arc-shaped and surrounds the connecting member.

3. The driving device of claim 2, wherein the first securing part and the second securing part are arranged in the same line.

4. The driving device of claim 2, further comprising a securing panel, wherein the securing panel defines a receiving hole corresponding to the opening, and the connecting member passes through the receiving hole and the opening.

5. The driving device of claim 4, further comprising a base, wherein the base comprises two separating panels, and the pushing member is placed between the two separating panels.

6. The driving device of claim 5, wherein the two separating panels are substantially parallel to each other.

7. The driving device of claim 5, wherein each separating panel comprises a hook, and the securing panel defines two securing holes corresponding to the two hooks.

8. The driving device of claim 5, wherein the base further comprises a bottom panel connected to the two separating panels, and the two separating panels are substantially perpendicular to the bottom panel.

9. The driving device of claim 5, wherein each of the two first clasping portion defines a plurality of dents.

10. The driving device of claim 1, wherein the two first securing portions and the two second securing portions are radioactively placed on the securing tray to surround the opening.

11. A driving device, comprising:

a base, the base comprises a bottom panel and two separating panels mounted on the bottom panel;

a pushing member placed between the two separating panels, the pushing member comprises a pushing portion and a securing end extending from the pushing portion;

a securing member, the securing member comprises a securing tray, two first securing portions extending from the securing tray, two second securing portions extending from the securing tray, and two handle portions extending from the securing tray; the securing tray defines an opening; a first clasping slot is defined in each of the two first securing portions; and a second clasping slot is defined in each of the two second securing portions; and a driving assembly, the driving assembly comprises a connecting member received in the opening;

wherein the securing end is clasped in the two first clasping slots and is configured to be clasped in the two second clasping slots to change a rotation angle of the pushing portion.

12. The driving device of claim 11, wherein the securing end comprises a first securing part, a connecting portion extending from the first securing part, a second securing part connected between the connecting portion and the pushing portion; and the connecting portion is arc-shaped and surrounds the connecting member.

13. The driving device of claim 12, wherein the first securing part and the second securing part are arranged in the same line.

14. The driving device of claim 12, further comprising a securing panel placed on the bottom panel, wherein the securing panel defines a receiving hole corresponding to the opening, and the connecting member passes through the receiving hole and the opening.

15. The driving device of claim 14, wherein each separating panel comprises a hook, and the securing panel defines two securing holes corresponding to the two hooks.

16. The driving device of claim 11, wherein the two first securing portions and the two second securing portions are radioactively placed on the securing tray to surround the opening.

17. The driving device of claim 11, wherein the two separating panels are substantially parallel to each other.

18. The driving device of claim 11, wherein the two separating panels are substantially perpendicular to the bottom panel.

* * * * *